US005505316A

United States Patent [19]

Lee

[11] Patent Number: 5,505,316

[45] Date of Patent: Apr. 9, 1996

[54] ADJUSTABLE WRENCH-RACK

[75] Inventor: Jon-Mau Lee, Chang Hua, Taiwan

[73] Assignee: Kwi Jun Enterprise Limited, Chang Hua, Taiwan

[21] Appl. No.: 282,338

[22] Filed: Jul. 29, 1994

[51] Int. Cl.[6] ..... A47F 7/00

[52] U.S. Cl. ..... 211/70.6; 211/87; 211/175; 211/63; 211/99; 206/376

[58] Field of Search ..... 211/70.6, 70.7, 211/70.8, 62, 63, 64, 65, 66, 87, 99, 175, 89, 2; 206/372, 376, 377; 248/207

[56] References Cited

U.S. PATENT DOCUMENTS

| | | | |
|---|---|---|---|
| 3,702,136 | 11/1972 | Albertson | 211/60 T |
| 3,822,019 | 7/1974 | Baatz | 211/60 T |
| 3,837,477 | 9/1974 | Boudreau | 206/72 |
| 4,108,312 | 8/1978 | Craven | 211/89 X |
| 4,705,168 | 11/1987 | Ward | 206/373 |

*Primary Examiner*—Karen J. Chotkowski
*Assistant Examiner*—Brian J. Hamilla
*Attorney, Agent, or Firm*—Pro-Techtor International

[57] ABSTRACT

An adjustable wrench-rack comprises a hanging body and two retaining bodies. The hanging body is provided with a plurality of locking holes. Each of the two retaining bodies is provided on a rear surface thereof with a plurality of threaded holes for fastening the retaining body to the hanging body by bolts engageable with the threaded holes and the locking holes. The two retaining bodies are provided respectively on a front surface thereof with a plurality of retaining slots in which the ring wrench, the double-ended wrench and the combination wrench are held securely. The retaining slots are provided respectively with an opening and a hooked body serving to prevent the wrench from slipping out of the retaining slot in which it is held.

1 Claim, 6 Drawing Sheets

ADJUSTABLE WRENCH-RACK

BACKGROUND OF THE INVENTION

The present invention relates generally to a rack for holding wrenches (spanners), and more particularly to an adjustable rack for holding wrenches.

There are various wrenches,such as ring wrench, double-ended wrench, combination wrench, etc. Each of the above-mentioned wrenches is generally sold in a package containing a plurality of wrenches of different sizes. The wrenches are generally kept in a tool box along with other hand tools. In order to facilitate a hand tool user to have an easy access to a wrench of a desired size, the wrenches of various sizes are held by a plurality of holding pins 11 of a rack 10 which is fastened to the wall of a workshop, as shown in FIG. 1. Such a conventional wrench rack as described above has several inherent shortcomings, which are expounded explicitly hereinafter.

The holding pins 11 of the rack 10 are not suitable for holding various wrenches. For example, a double-ended wrench can not be held securely by a single pin; therefore it must be held between or on two holding pins 11 which are juxtaposed at an interval in a parallel manner. It is readily apparent that not all of ring wrenches, double-ended wrenches and combination wrenches can be held on the rack 10 even if all of the holding pins 11 are arranged in pair in various ways.

The wrenches,which are hung or held horizontally on the holding pins 11 of the rack 10, are not located securely so that they can be caused easily and accidentally to fall on the floor and that they are potential safety hazards.

In addition to the wrench rack described above, there are luggage-type tool boxes of an iron or plastic material, and the wrench bag of a plastic material. The luggage-type tool boxes are generally provided therein with a plurality of clamping bodies and slots of various sizes and shapes for holding and locating the wrenches. Such luggage-type tool boxes as described above are defective in design in that they are suitable for use in holding only one kind of the wrench and that they must be opened to permit a user to have an access to a desired wrench.

The afore-mentioned wrench bag is provided with a plurality of pouches of various sizes for holding therein wrenches of various sizes and kinds. However, the wrench bag described above is made of a plastic skin, which is subject to deterioration caused by the weather conditions, and is therefore not durable. In addition, the wrench bag is rather prone to be torn apart by the wrenches which are held in the wrench bag.

SUMMARY OF THE INVENTION

It is therefore the primary objective of the present invention to provide an adjustable rack for hanging simultaneously or holding horizontally and simultaneously the ring wrench, the double-ended wrench and the combination wrench.

It is another objective of the present invention to provide an adjustable rack, which can be used interchangeably to hang or hold horizontally the ring wrench, the double-ended wrench and the combination wrench.

It is still another objective of the present invention to provide an adjustable rack, which can be adjusted according to the various sizes of the wrenches, so as to hold securely the wrenches of different forms.

In keeping with the principle of the present invention, the foreging objectives of the present invention are attained by an adjustable wrench-rack, which consists of a hanging body and two retaining bodies. The hanging body is provided with long locking holes and unitary locking holes for fastening the retaining bodies by means of screws such that the retaining bodies can be located upwards and downwards and that the retaining bodies can be located obliquely. The retaining bodies are provided with hooked bodies, openings and retaining slots for holding the ring wrench, the double-ended wrench, and the combination wrench.

The foreging objectives, features and advantages of the present invention will be more readily understood upon a thoughtful deliberation of the following detailed description of the present invention in conjunction with the accompanying drawings.

DETAILED DESCRIPTION OF THE INVENTION

Figure 1:
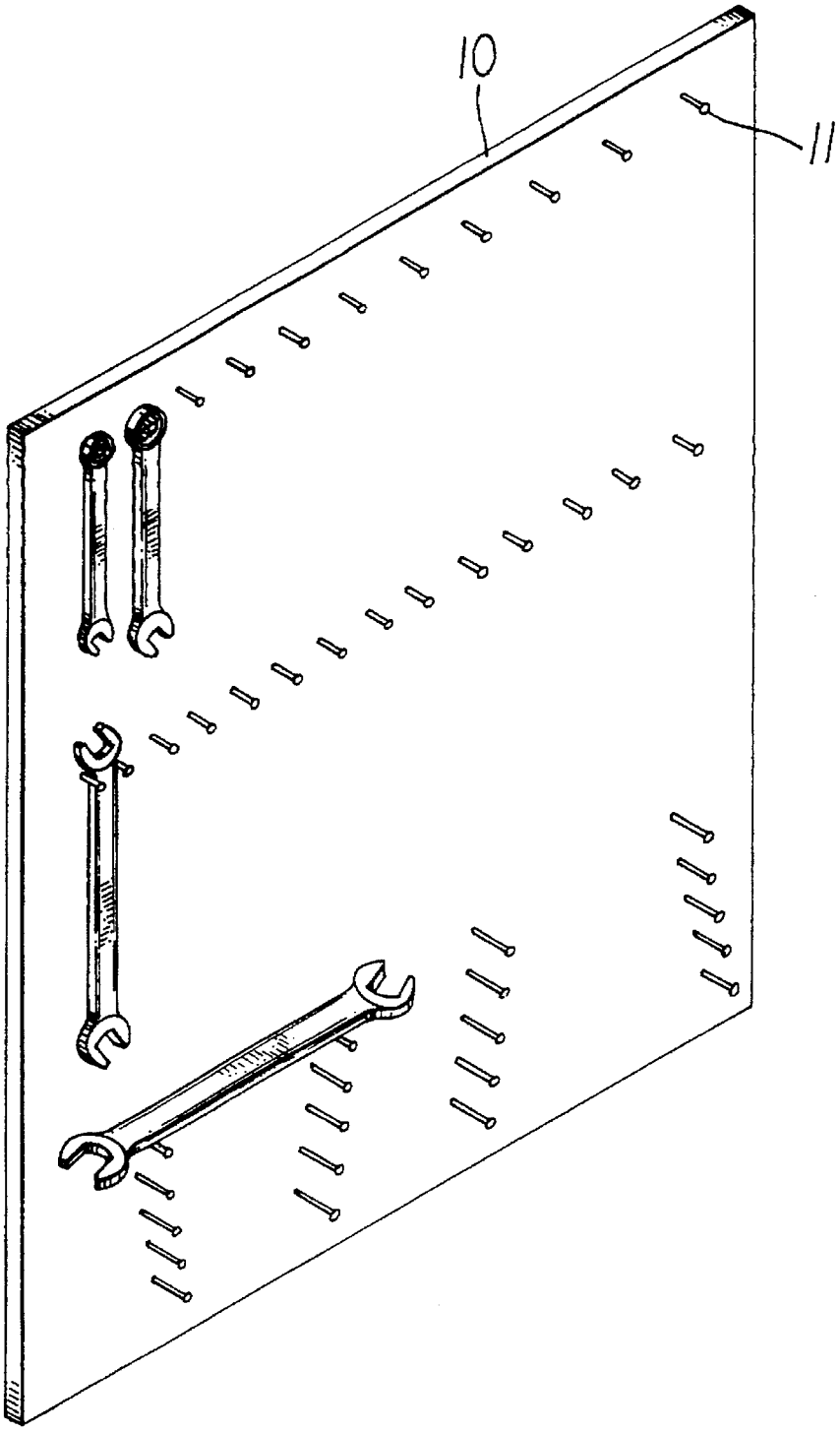
FIG.1 PRIOR ART
FIG. 1 shows a schematic view of a wrench rack of the prior art.
Figure 2:
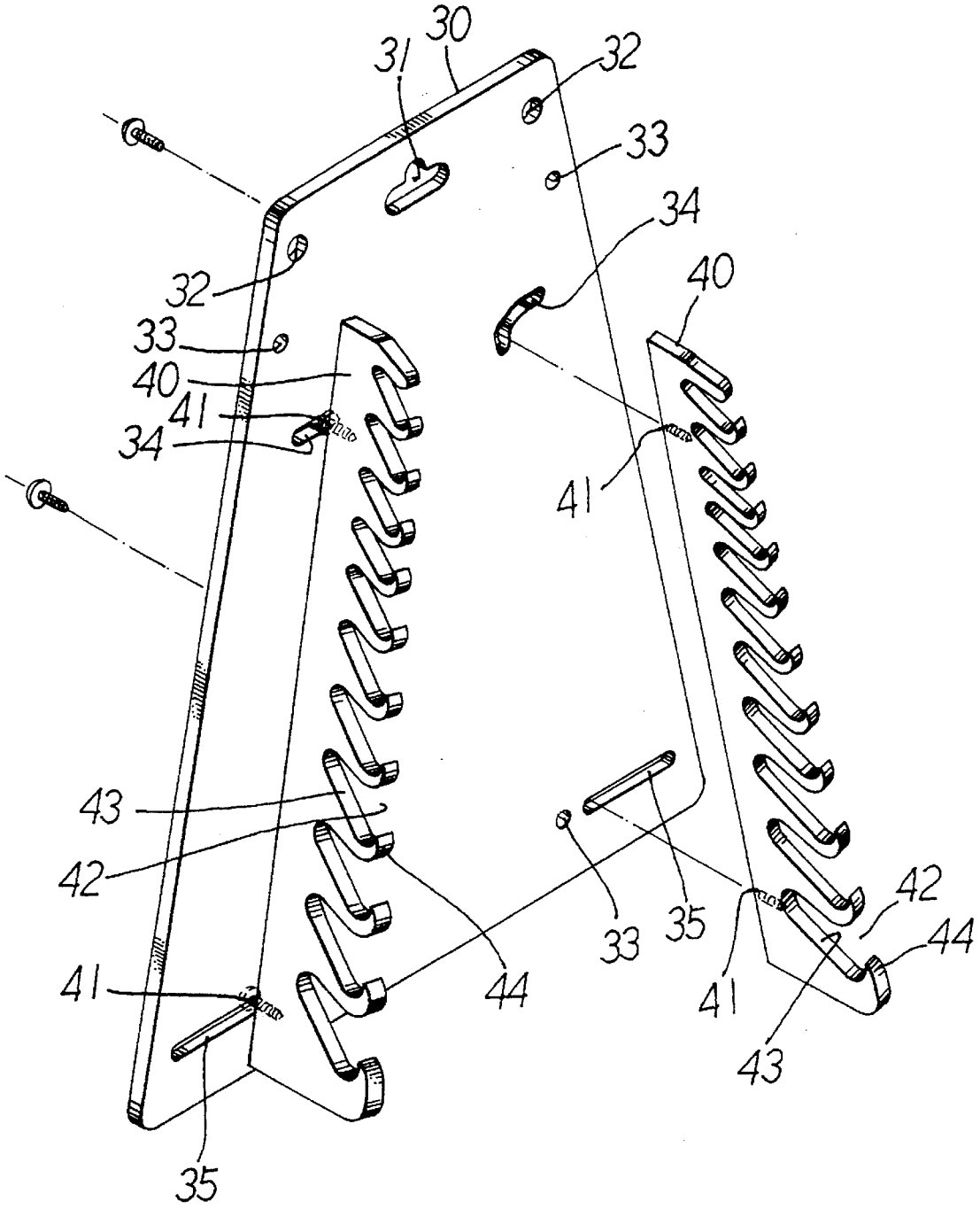
FIG. 2 shows an exploded view of the present invention.
Figure 3:
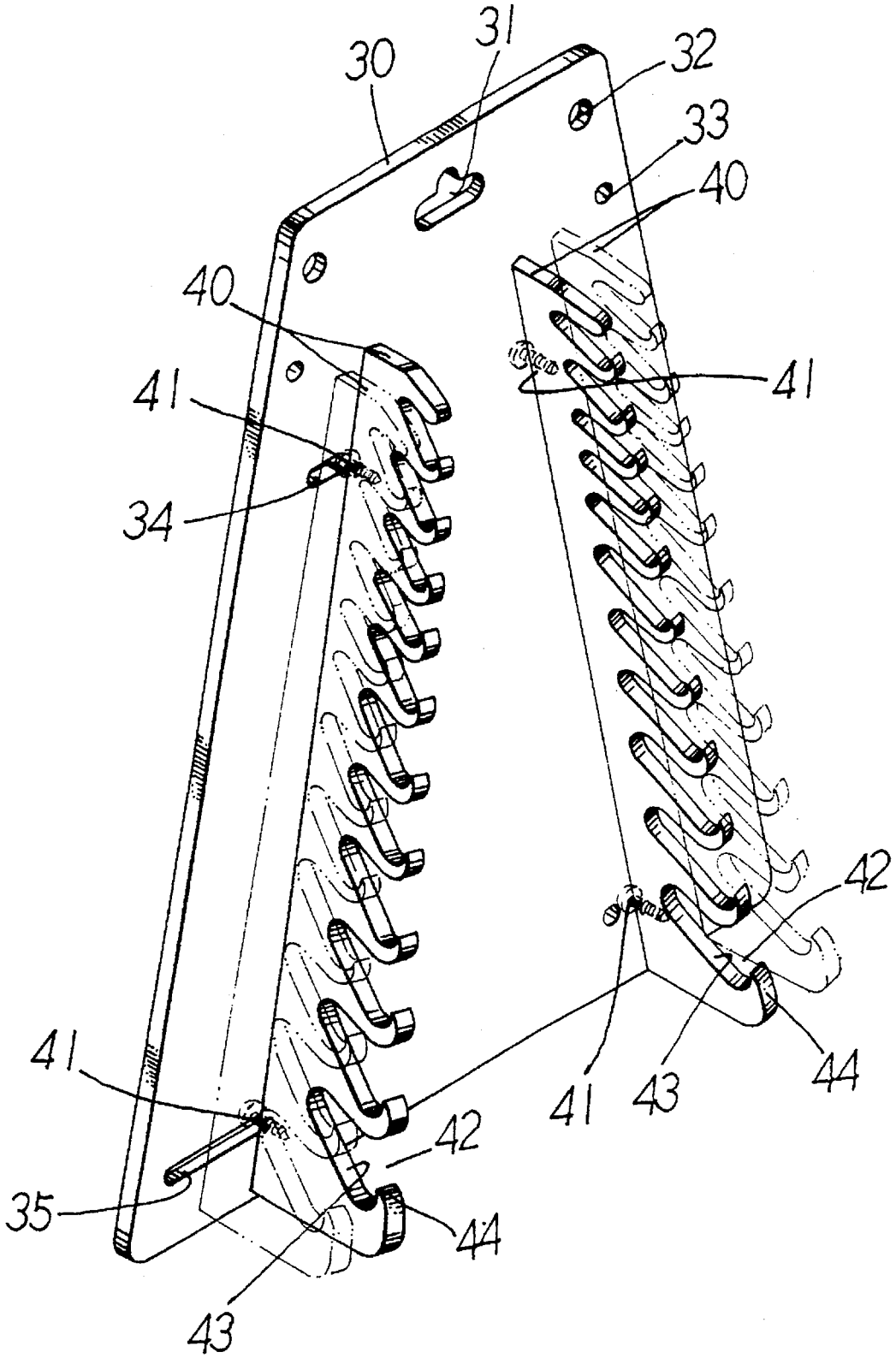
FIG. 3 shows a perspective view of the present invention for holding the wrenches horizontally.

As shown in FIGS. 2 and 3, the adjustable wrench-rack of the present invention comprises mainly a hanging body 30 and two identical retaining bodies 40.

The hanging body 30 of a platelike construction may have any shape and is provided in the upper segment thereof with a hanging hole 31 which is located between two fixing holes 32. The hanging hole 31 is intended to hang the hanging body 30 on the wall. There are two pairs of locking holes 33 on the hanging body 30, each pair being centered about a vertical centerline of the hanging body. In addition, the hanging body 30 is provided in the midsegment thereof with two arcuate locking holes 34 corresponding in location to each other. Moreover, the hanging body 30 is provided in the lower segment thereof with two horizontal long locking holes 35 corresponding in location to each other.

Each of the retaining bodies 40 is provided in a rear surface thereof with several threaded holes 41 corresponding in location to locking holes 34, and 35 of the hanging body 30 and engageable with bolts for fastening the retaining bodies 40 to the hanging body 30. Each of the two retaining bodies 40 is provided on a front surface thereof with a plurality of retaining slots 43 having an opening 42. Each of the retaining slots 43 has an upper bevel wall and a lower bevel wall, which are angled such that the opening 42 is widened gradually from the top toward the bottom thereof. The lower bevel wall of each retaining slot 43 is projected upwards to form a hooked body 44.

Figure 4:
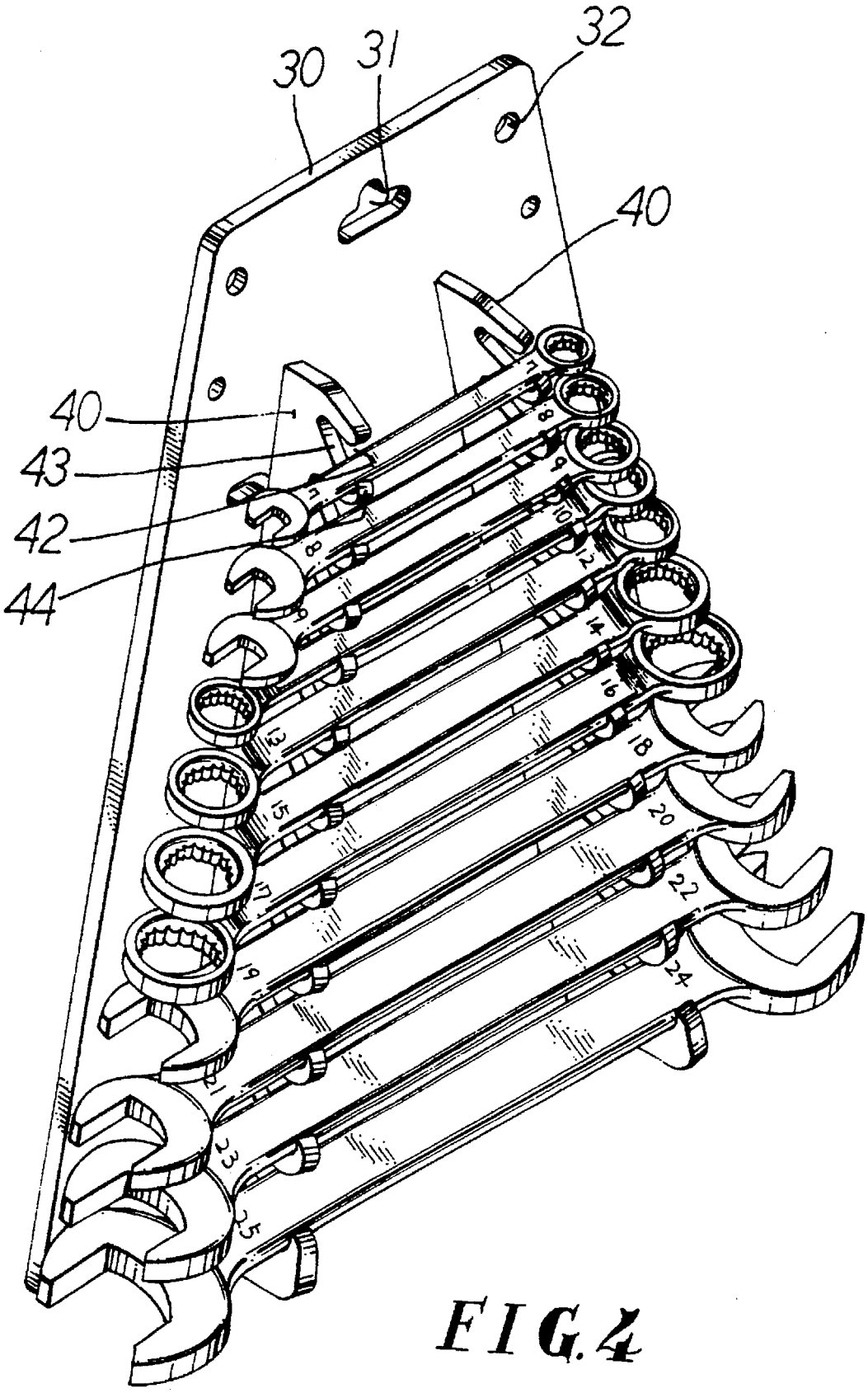
FIG. 4 is a schematic view showing that various wrenches are held horizontally on the rack as shown in FIG. 3.

As shown in FIG. 3, the retaining bodies 40 are fastened to the hanging body 30 by means of the threaded holes 41 and bolts which are engageable with the threaded holes 41 and the arcuate locking holes 34 and the horizontal long locking holes 35 of the hanging body 30. Depending on the sizes of the wrenches to be held in the retaining bodies 40 of the present invention, the interval between the two retaining bodies 40 may be adjusted as desired by sliding the retaining bodies 40 along the horizontal long locking holes 35. As la result, various wrenches, such as the ring wrench, the double-ended wrench,and the combination wrench, can be held in the retaining slots 43 via the openings 42 such that the wrenches are prevented from slipping out of the retaining slots 43 by the hooked bodies 44 of the retaining slots 43,as shown in FIG. 4.

The retaining slots 43 of the retaining bodies 40 are arranged at an interval and have an appropriate inclination, thereby permitting the scales marked on the wrenches kept in the retaining slots 43 to be seen easily by a user of the wrenches.

A wrench which is held in the retaining slot 43 can be easily removed therefrom by lifting slightly the wrench before removing it from the retaining slot 43 via the opening 42. On the other hand, the removed wrench can be easily put back into the retaining slot 43 by inserting the handle of the removed wrench into the retaining slot 43 via the opening 42. The hooked body 44 of the retaining slot 43 serves to prevent the wrench from slipping out of the retaining slot 43 in which it is held.

Figure 5:
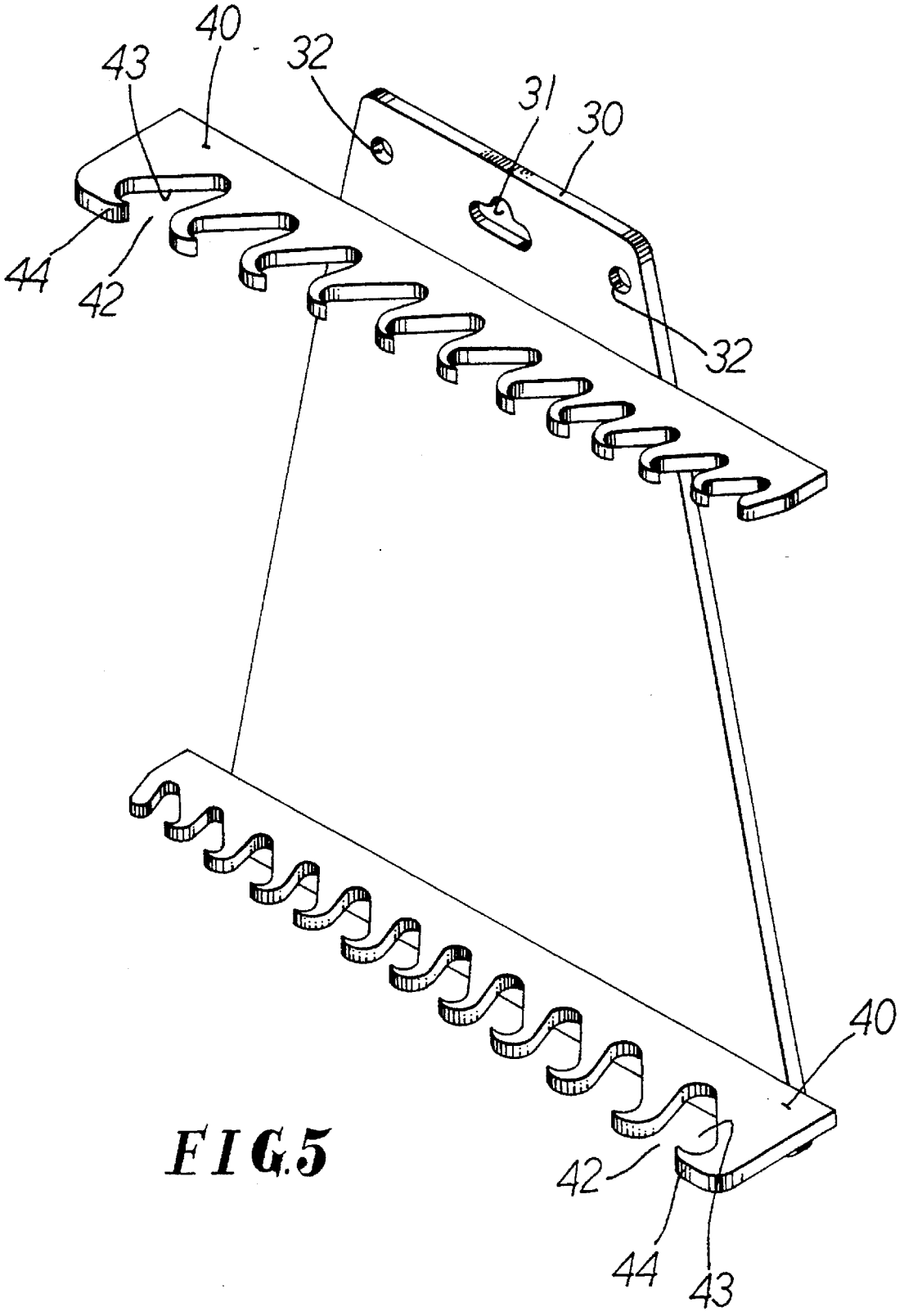
FIG. 5 shows a perspective view of the present invention for holding the wrenches uprightly.
Figure 6:
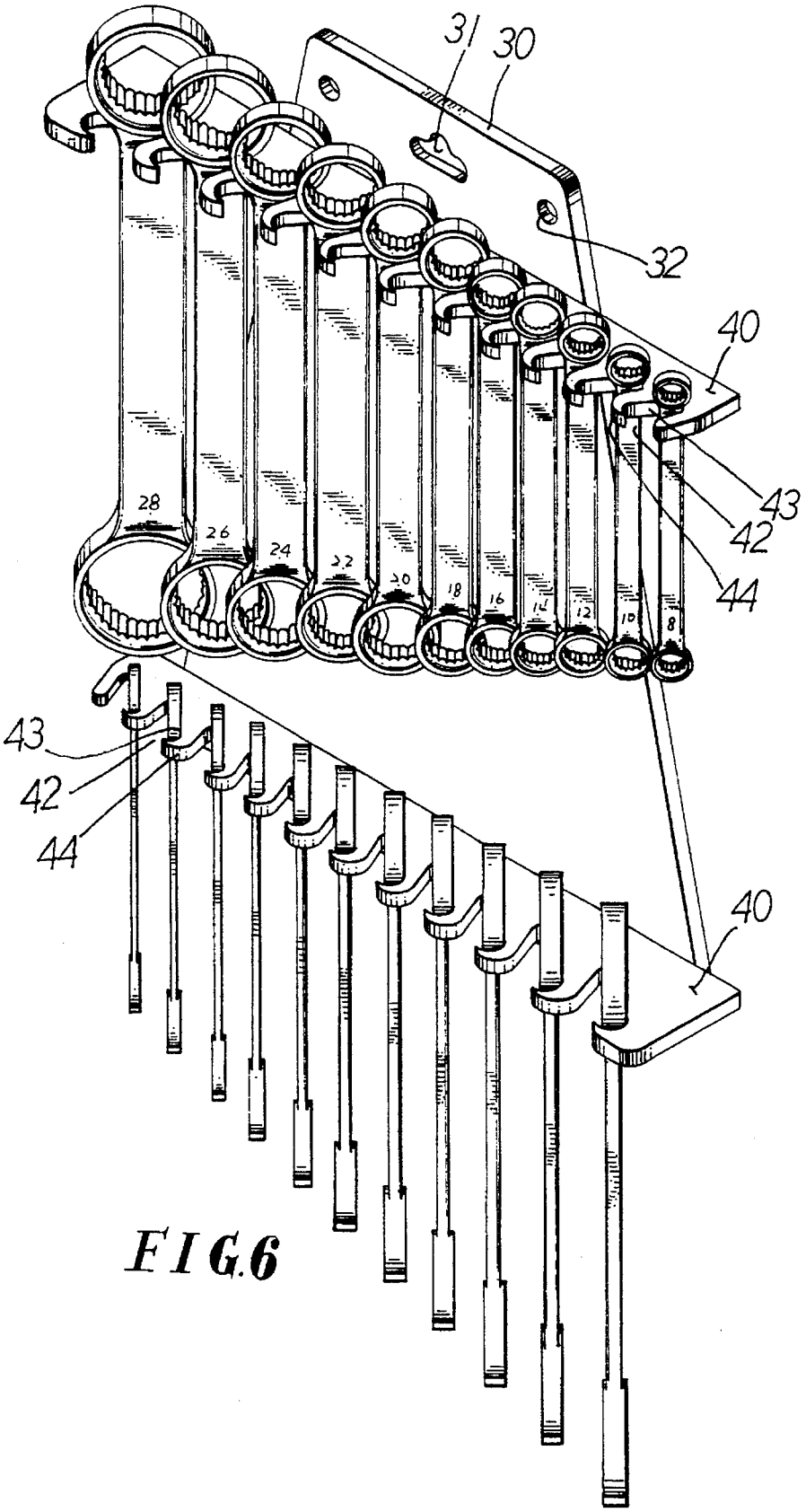
FIG. 6 is a schematic view showing that various wrenches are hung on the rack as shown in FIG. 5.

As shown in FIG. 5, the two retaining bodies 40 of the present invention are fastened to the hanging body 30 such that the two retaining bodies 40 are arranged horizontally at an interval,and that the threaded holes 41 of the retaining bodies 40 are corresponding in location to the locking holes 33 of the hanging body 30. The two retaining bodies 40 are thus fastened to the hanging body 30 by means of bolts engageable with the threaded holes 41 of the retaining bodies 40 and the locking holes 33 of the hanging body 30. As shown in FIG. 6, a plurality of various wrenches are hung respectively in the retaining slots 43 of the retaining bodies 40. The head portion of each wrench has a dimension which is slightly greater than the size of the opening 42 of the retaining slot 43. As a result, the wrench is hung securely in the retaining slot 43. Furthermore, the retaining slots 43 are kept at an interval and an angle so that the scales or the numbers marked on the wrenches can be seen easily.

The embodiments of the present invention described above are to be regarded in all respects as merely illustrative and not restrictive. Accordingly, the present invention may be embodied in other specific forms without deviating from the spirit thereof. The present invention is therefore to be limited only by the scope of the following appended claim.

What is claimed is:

1. An adjustable wrench-rack comprising:

a hanging body which includes in an upper segment thereof fixing holes centered around a vertical centerline of the hanging body with a hanging hole situated between the fixing holes, said hanging body further includes at least one pair of locking holes and a pair of arcuate locking holes, said hanging body further including a pair of horizontal long locking holes;

two retaining bodies are affixed to a front surface of the hanging body by fastening means which pass through the arcuate locking holes and the horizontal long locking holes and are received in a rear surface of the retaining bodies, the retaining bodies have on a front surface thereof a plurality of retaining slots which are arranged at intervals along the length of the retaining bodies, and which include an opening formed by an upper wall and a lower wall, the upper wall having an outer end which extends upward to form a hooked body, the upper and lower walls being angled so that the opening gradually increases in size from a front end of said opening to a rear end of said opening.

* * * * *